US007731029B2

(12) United States Patent
Su

(10) Patent No.: US 7,731,029 B2
(45) Date of Patent: Jun. 8, 2010

(54) TRAY FOR LOADING SUBSTRATES AND PACKAGE BOX FOR CARRYING THE TRAY

(75) Inventor: Hung-Chi Su, Hsin-Chu (TW)

(73) Assignee: AU Optronics Corp., Hsinchu (TW)

( * ) Notice: Subject to any disclaimer, the term of this patent is extended or adjusted under 35 U.S.C. 154(b) by 209 days.

(21) Appl. No.: 11/889,798

(22) Filed: Aug. 16, 2007

(65) Prior Publication Data

US 2008/0202980 A1 Aug. 28, 2008

(30) Foreign Application Priority Data

Feb. 27, 2007 (TW) ..... 96106730 A

(51) Int. Cl.
*B65D 85/48* (2006.01)
*B65D 85/00* (2006.01)
*B65D 1/34* (2006.01)
*B65D 81/02* (2006.01)

(52) U.S. Cl. ..... 206/454; 206/722; 206/564; 206/585

(58) Field of Classification Search ..... 206/701, 206/707, 723, 449, 453–456, 499, 562–565, 206/521, 585, 586, 722, 593; 220/503, 504
See application file for complete search history.

(56) References Cited

U.S. PATENT DOCUMENTS 2,783,930 A * 3/1957 Riley ..... 206/521
4,132,311 A * 1/1979 Glinert ..... 206/387.14
4,972,951 A * 11/1990 Vartanian ..... 206/387.1
5,085,758 A * 2/1992 Guadagno et al. ..... 206/449
D352,199 S * 11/1994 Stumpff et al. ..... D6/632
5,531,329 A * 7/1996 Hayakawa et al. ..... 206/722
6,298,989 B1 * 10/2001 Chu ..... 206/320
6,813,005 B2 * 11/2004 Guo ..... 355/75
6,915,904 B2 * 7/2005 Winkler ..... 206/559
7,093,717 B2 * 8/2006 Sakai et al. ..... 206/591
2007/0095703 A1 * 5/2007 Kao et al. ..... 206/454

* cited by examiner

*Primary Examiner*—Mickey Yu
*Assistant Examiner*—Melissa L Lalli
(74) *Attorney, Agent, or Firm*—Bacon & Thomas, PLLC

(57) ABSTRACT

A tray for loading substrates includes a base, an outer frame, plural lateral supporters and plural corner bumps. The base has an upper surface with one or more grooves. The outer frame is located around four edges of the upper surface to thereby form a first space, and has two oppositely arranged first cavities. The lateral supporters are arranged on the base at four edges defining the first space against the outer frame, have second cavities arranged on internal surfaces of the lateral supporters and corresponding to the grooves. The corner bumps are arranged at corners of the outer frame, and are adjacent to the lateral supporters, the base and the outer frame. The corner bumps each have buffer openings to prevent a loaded substrate from damage by collision with the corner bumps. A package box is also disclosed, which can save cost and space in carrying the trays.

9 Claims, 6 Drawing Sheets

TRAY FOR LOADING SUBSTRATES AND PACKAGE BOX FOR CARRYING THE TRAY

BACKGROUND OF THE INVENTION

1. Field of the Invention

The present invention relates to a tray for loading substrates and a package box for carrying the tray, and more particularly, to a tray for loading differently sized substrates and a package box for carrying the tray.

2. Description of Related Art

For avoiding reduced space utility and increased transport cost in mass transportation, convenient carry and efficient transportation are required for storing or delivering liquid crystal display (LCD) panels. Currently, the boxes used for loading the LCD panels in the trades are sized or stacked as a need for delivering and protecting the LCD panels.

A typical box size for the LCD panels is designed and determined by the size of four middle substrates divided into from a large substrate (i.e., a front-end substrate) in a front-end processing.

FIG. 1 is a schematic view of a typical substrate arrangement placed in differently sized boxes. As shown, a front-end substrate 10 is divided into four middle substrates A, B, C, D which have different sizes and require corresponding boxes 1*a*, 1*b*, 1*c*, 1*d* for carry. Thus, molding cost for the boxes is increased and working space utility for the boxes are reduced, and the four boxes, each carrying a different quantity of substrates, increase difficulties in package and material management for the front-end substrate 10.

In addition, the current transportation places the four sized boxes 1*a*, 1*b*, 1*c*, 1*d* in a large iron case. Accordingly, the available space for use is wasted and the carrying amount is relatively reduced, because the unused space is filled with foaming materials. In this case, since the productivity is increased day by day, such a manner of transportation relatively increases the cost.

For protecting LCD modules so as to avoid the transport losses from collision in carrying, four buffer openings are provided on the corners of the boxes 1*a*, 1*b*, 1*c*, 1*d*, but it makes the operator in a customer's production line incapable of quickly taking the LCD panels out of the boxes.

Therefore, it is desirable to provide an improved tray for loading substrates so as to mitigate and/or obviate the aforementioned problems.

SUMMARY OF THE INVENTION

An object of the present invention is to provide a tray for loading substrates so as to reduce difficulties of material management and to increase convenience of substrate loading in the front-end production line. The invention improves the package for the unequally divided substrates by providing a tray to concurrently load the divided substrates of different sizes.

Another object of the present invention is to provide a package box for carrying the tray, wherein the package box has a size equal to the maximum one among the divided substrates. Accordingly, the divided substrates of different sizes can be carried by the same package box, and that different boxes used for the substrates of four or two different sizes, as taught in the prior art, can be avoided. Therefore, available operating platform space, assembly speed in production line, storage space saving, and throughput are increased.

The tray for loading substrates, according to the present invention, includes a base, an outer frame, a plurality ofa a plurality ofity of lateral supporters and a plurality ofa a plurality ofity of corner bumps. The base has an upper surface with one or more grooves. The outer frame is located around four edges of the upper surface of the base to thereby form a first space, and has two oppositely arranged first cavities. The lateral supporters, which are arranged on the base at four edges defining the first space against the outer frame, have second cavities arranged on internal surfaces of the lateral supporters and corresponding to the one or more grooves on the upper surface of the base. The corner bumps are arranged at four corners of the outer frame, and are adjacent to the lateral supporters, the base, and the outer frame.

In the tray for loading substrates, the corner bumps each have a plurality ofa a plurality ofity of buffer openings to accordingly prevent a loaded substrate from damage caused by collision with the corner bumps.

Preferably, the grooves are arranged in the middle of the tray and more preferably two grooves are arranged as a cross-groove.

The corner bumps have the same height that is greater than that of the lateral supporters. The outer frame has symmetric inner walls and an interval between the symmetric inner walls is equal to a length or width of a substrate for accommodation of the substrate. Each of the lateral supporters located on the edges of the base has a height which is the same as that of the opposite lateral supporter, but which is different from that of the adjacent lateral supporters. An interval between the corner bumps is equal to the length or width of the substrate, such that the opposite lateral supporters of the same height, and the adjacent lateral supporters of the different height, are used, respectively, to load two different substrates. An interval between the lateral supporters in symmetry is equal to the length or width of the substrate for loading a substrate on the base. Accordingly, the tray can load a plurality of substrates with the same or different sizes. The tray is preferably provided for loading glass substrates, and more preferably LCD substrates. The tray preferably loads four substrates with all different sizes or with two different sizes. The tray is formed of polycarbonate by injection molding or press molding or vacuum forming.

The invention also provides a package box, which includes a box base, a box frame, and the tray. The box frame is located around four edges of an upper surface of the box base to thereby form a second space in order to contain the tray. A tray recess is arranged at one or more inner walls of the box frame, and a tray opening is arranged at each corner of the box frame.

An interval between the inner walls of the box frame is equal to a length or width of the tray for accommodation of the tray.

In a preferred embodiment, the package box further has a cover to cover the package box for convenient storage or carry.

In a preferred embodiment, the tray recess is arranged, respectively, on the opposite inner walls of the box frame.

In a preferred embodiment, the package box can load a plurality of trays with the same size, and the number of the trays is preferably three or more, each tray having substrates with the same or different size. The package box is preferably formed of a foaming polypropylene (EPP) by injection or press molding.

Thus, the invention essentially uses a tray to concurrently load the divided substrates with different sizes and a package box with a size equal to the maximum one among the divided substrates to carry the tray containing the substrates. Accordingly, the divided substrates with the different sizes are concurrently carried by the same package box. In addition, correlation between the edges of the substrates is used to optimize the package design. Thus, an operator on the production line can load and pack the substrates quickly, and that the operating platform space is increased. The problem inherent in the prior art that a large substrate is divided into differently sized substrates which respectively require a different box is overcome by the invention in which only a single size box is required. Accordingly, the box material cost is effectively reduced, and the complexity in handling the part numbers of the material management is reduced. The package box in the invention can increase the effective use and plan of storage room, and the optimized stack design on the tray can increase the loaded amount without affecting the structure design and strength of the package box, thereby effectively reducing the cost and providing a single size load to a customer for easily handling and controlling the amount of goods.

Other objects, advantages, and novel features of the invention will become more apparent from the following detailed description when taken in conjunction with the accompanying drawings.

DETAILED DESCRIPTION OF THE PREFERRED EMBODIMENT

First Embodiment

Figure 1:
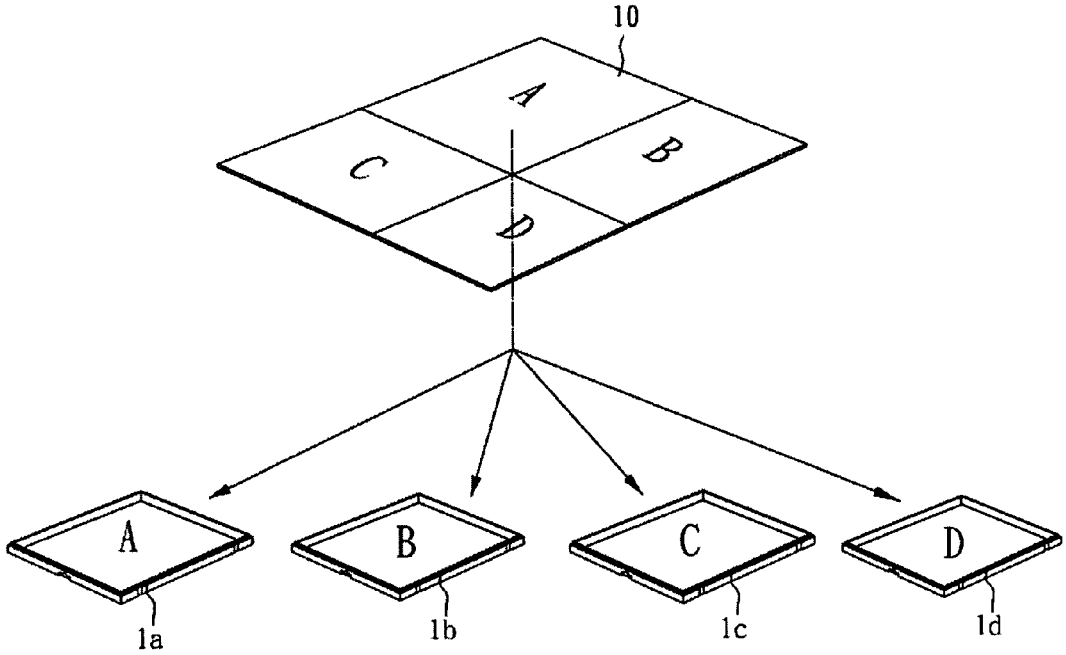
FIG. 1 (PRIOR ART)
FIG. 1 is a schematic view of a typical substrate arrangement placed in differently sized boxes.
Figure 2:
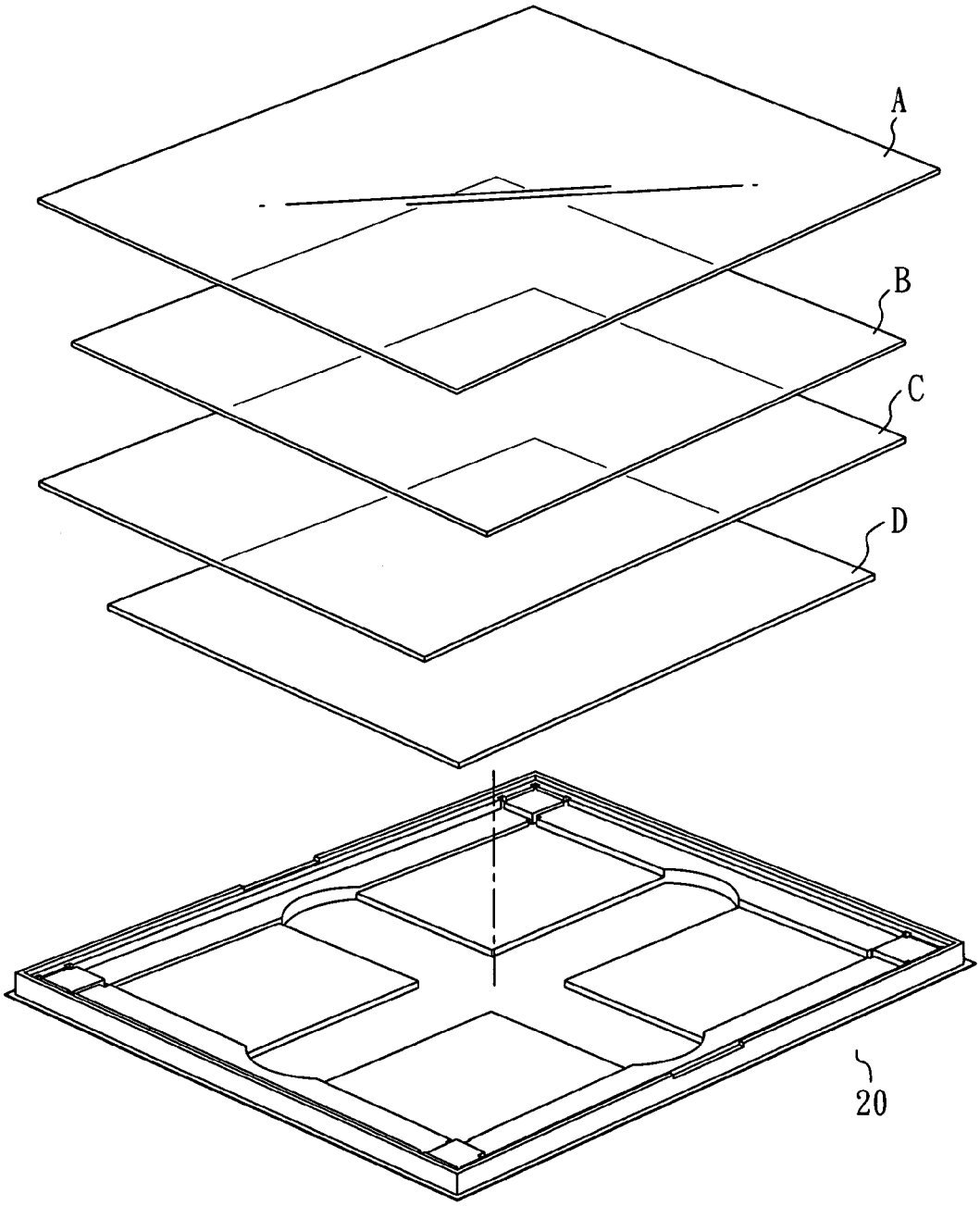
FIG. 2 is a schematic view of a tray for loading substrates according to a first embodiment of the present invention.
Figure 3:
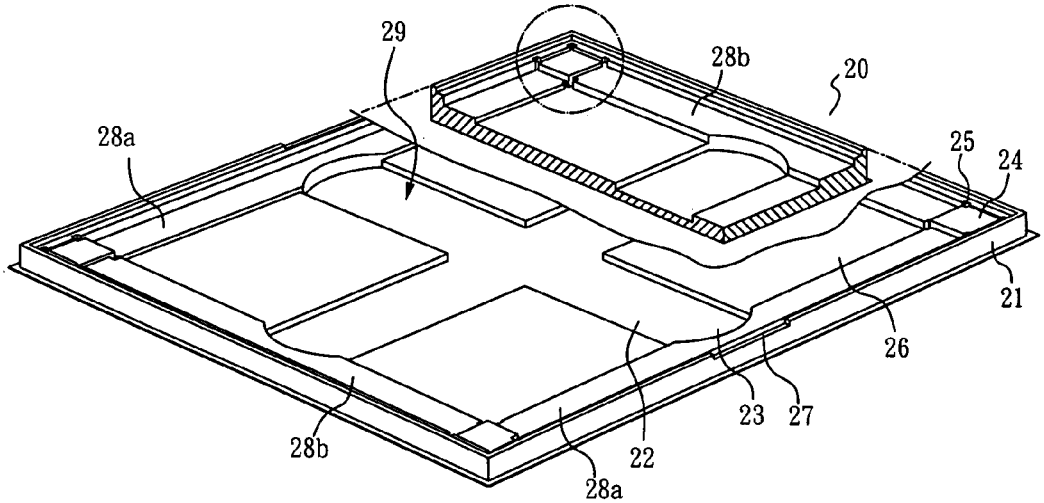
FIG. 3 is a schematic view of the tray, with partial section, for loading the substrates according to the first embodiment of the present invention.
Figure 4:
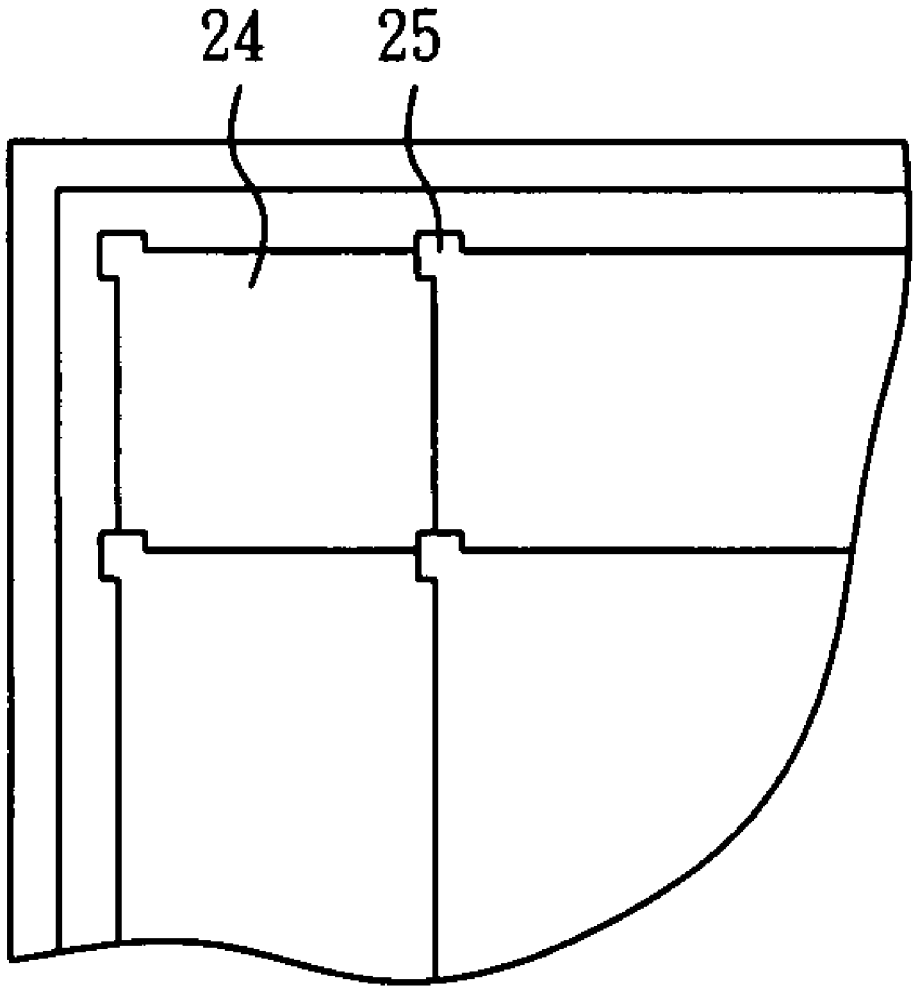
FIG. 4 is an enlarged top view illustrating a corner bump and its buffer openings according to the first embodiment of the invention.

This embodiment is referred to in FIGS. 2 to 4, where FIG. 2 is a schematic view of a tray for loading substrates, FIG. 3 is a schematic view of the tray, with partial section, for loading the substrates, and FIG. 4 is an enlarged top view illustrating a corner bump and its buffer openings.

As shown in FIG. 2, a large substrate is sized into four substrates A, B, C, D of different sizes, and the substrates A, B, C, D are arranged into the tray 20 in an optimum series from small to large. The large substrate is a glass substrate.

As shown in FIG. 3, the tray 20 for loading the substrates A, B, C, D is made of polycarbonate by injection molding. The tray 20 includes a base 26, an outer frame 21, a plurality of lateral supporters 28*a*, 28*b*, and a plurality of corner bumps 24. The base 26 has an upper surface with a cross-groove 22. The outer frame 21 is located around four edges of the upper surface of the base 26 to thereby form a first space 29, and has two oppositely arranged first cavities 27. The cross-groove 22 divides the base 26 into four equal parts for strengthening the structure of the tray 20 and for avoiding deformation or breakdown of the tray 20 from receiving the substrates A, B, C, D. The lateral supporters 28*a*, 28*b* are arranged on the base 26 at four edges defining the first space 29 against the outer frame 21 and have a second cavity 23 arranged on each internal surface of the lateral supporters 28*a*, 28*b* and corresponding to the cross-groove 22. The lateral supporters 28*a*, which are against the sides of the outer frame 21 with the first cavities 27, have a height different from that of the lateral supporters 28*b*, which are against the sides of the outer frame 21 without the first cavities 27. The first cavities 27 and the second cavities 23 are so arranged that the substrates A, B, C, D can be conveniently taken out of the tray 20 to accordingly avoid damage. The corner bumps 24 are arranged at four corners of the base 26, and are adjacent to the outer frame 21 and the lateral supporters 28*a*, 28*b*. As shown in FIG. 4, the corners of each corner bump 24 are provided with a buffer opening 25, respectively, for avoiding the corners of the substrates A, B, C, D from collision and damage when the substrates A, B, C, D are each received in a respective accommodating location.

The arrangement of the substrates A, B, C, D is further described. For example, the arrangement firstly uses the interval between the symmetric lateral supporters 28*a* or 28*b* that equals to the length or width of the substrate D in order to load the substrate D. Namely, the base 26 is used as the plane for loading the substrate D. Next, the interval between the corner bumps 24 equals to the length or width of substrate C or B in order to load the substrates C, B. Namely, the lateral supporters 28*a* are used as the plane for loading the substrate C to thereby carry the substrate C, and that the lateral supporters 28*b* are used as the plane for loading the substrate B to thereby carry the substrate B. Finally, the interval between the symmetric inner walls of the outer frame 21 equals to the length or width of the substrate A in order to load the substrate A, and that the corner bumps 24 are used as the plane for loading the substrate A to thereby carry the substrate A. At this point, the buffer openings 25 arranged at the corners of the corner bumps 24 can function as a buffer to the substrates A, B, C, D.

Second Embodiment

Figure 5:
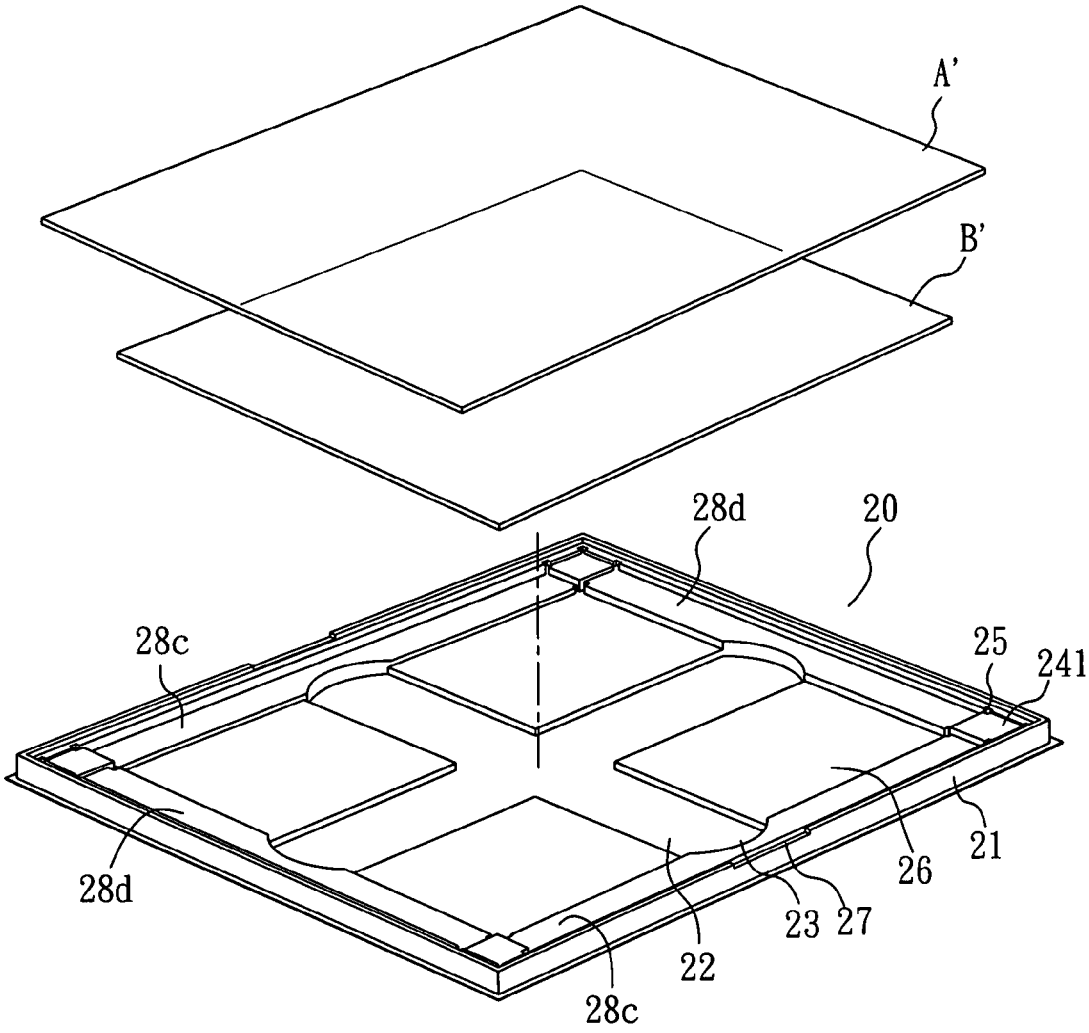
FIG. 5 is a schematic view of a tray for loading substrates according to a second embodiment of the present invention.

In this embodiment, a large substrate is divided into four middle substrates A', B' which have two sizes. Namely, the four middle substrates are divided into two pairs of middle substrates A', B', which has a different size to each other. In this case, a tray 20, like the one in the first embodiment, is used to load the middle substrates A', B'. As shown in FIG. 5, the tray 20 includes a base 26, an outer frame 21, a plurality of lateral supporters 28*c*, 28*d*, and a plurality of corner bumps 241, and the substrates A', B' are properly arranged in the tray 20, in a manner such as that shown in the first embodiment.

Third Embodiment

Figure 6:
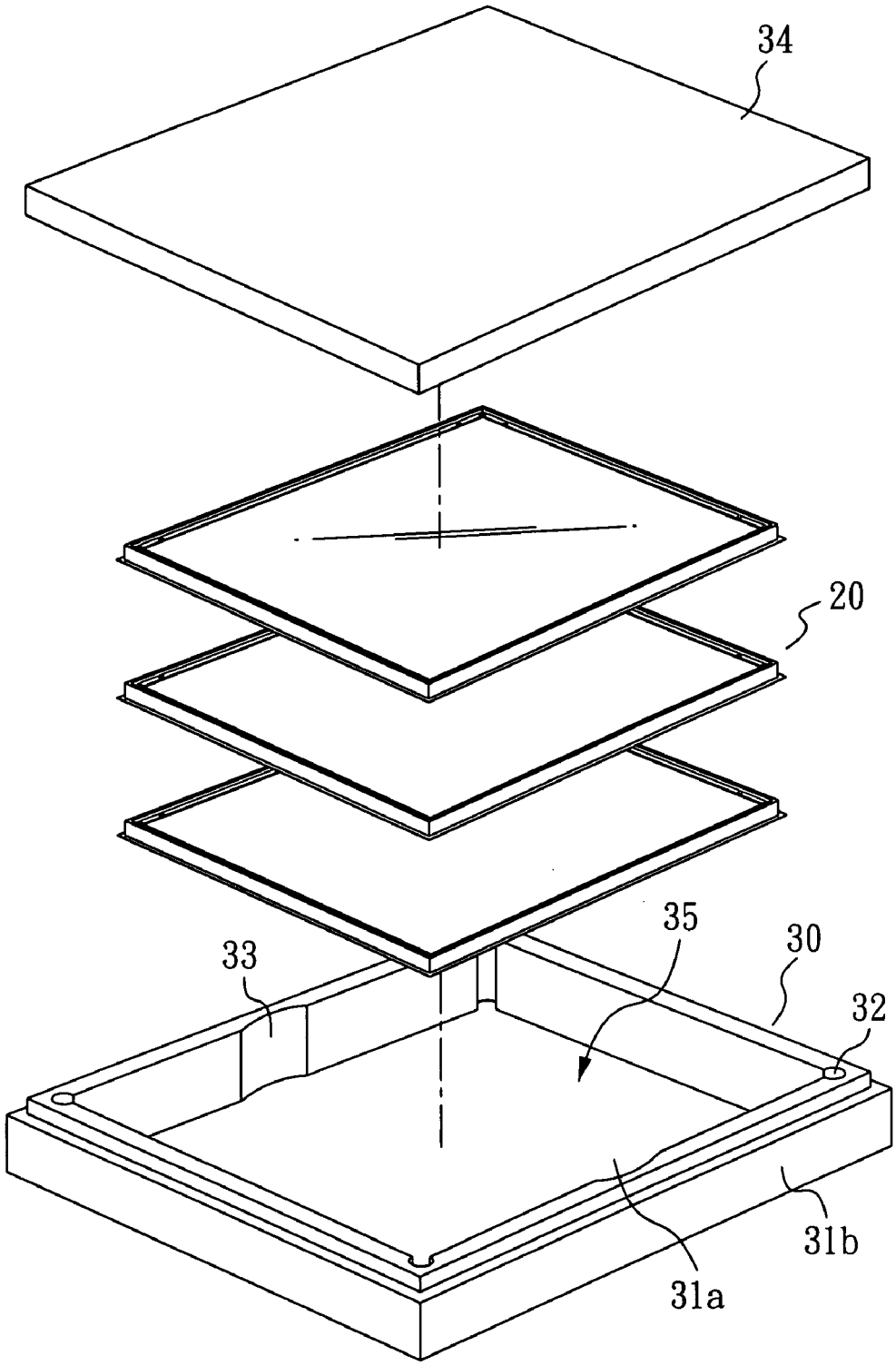
FIG. 6 is a schematic view of a package box for carrying the tray according to the second embodiment of the present invention.

As shown in FIG. 6, a package box 30 for carrying the tray 20 of the first embodiment or of the second embodiment can be formed of foaming polypropylene by injection molding, for example. The package box 30 includes a box base 31*a*, a box frame 31*b* and an upper cover 34. The box base 31*a* serves as a part for receiving the tray 20. The box frame 31*b* is located around four edges of an upper surface of the box base 31*a* to thereby form a space 35 which is sealed by the upper cover 34, has a tray recess 33 at two opposite inner walls of the box frame 31*b*, respectively, thereby the tray 20 can be easily and conveniently moved in and out of the package box 30, and is provided with a plurality of tray openings 32 at corners thereof to thereby protect the LCD module from collision and damage in carrying and from causing unnecessary losses. Such a package box 30 can place three trays 20 with the same size, i.e., 12 middle substrates (turned into from three large substrates), thereby reducing space waste and increase convenience on store and carry.

Box Measurement

Table 1 shows loading of typical small-size package boxes. As shown, an iron case can contain 30 package boxes, i.e., 360 middle substrates with four sizes A, B, C, D or 90 large substrates (for a large substrate is divided into four middle substrates) in total. In this situation, the iron case concurrently contains the package boxes with four sizes, which wastes the space, as shown in Table 2.

TABLE 1

Case loading and amount of typical four-in-one scheme - Typical four-in-one scheme (differently sized substrates placed in different package boxes)

| Model | Box number/iron case | Total loading amount |
|---|---|---|
| Concurrently loading of different sizes | 30 | 360 |

TABLE 2

Iron case utility rate of typical four-in-one scheme - Typical four-in-one scheme (differently sized substrates placed in different package boxes)

| Item | Total box volume ($m^3$) | Total case volume ($m^3$) | Remaining case space ($m^3$) |
|---|---|---|---|
| Concurrently loading of different sizes | 0.579 | 0.857 | 0.278 |

Table 3 shows the package box used in the present invention. As shown, only a package box with the same size is required for a large substrate that is further divided into four middle substrates. Accordingly, a one-size iron case can contain 34 package boxes which totally have 408 middle substrates or 102 large substrates (for a large substrate is divided into four middle substrates). Thus, the invention can load 12 large substrates more than the prior art. Taking an example for a current small-size LCD panel, a large substrate can be divided into 81 small substrates, and accordingly an iron case can contain 12×81=972 small substrates more. In addition, since the iron case is used to place the only one-size package box, the case space is less wasteful than that for the four-size package box, as shown in Table 4. Therefore, the transport cost is reduced, and the loading amount is increased so as to satisfy the customer requirement, save the number of boxes and raise the utility rate.

TABLE 3

Case loading and amount of the invention Invention (differently sized substrates placed all together in a one-size package box)

| Model | Box number/iron case | Total loading amount |
|---|---|---|
| Only loading size A | 34 | 408 |

TABLE 4

Iron case utility rate of the invention Invention (differently sized substrates placed all together in a one-size package box)

| Item | Total box volume ($m^3$) | Total case volume ($m^3$) | Remaining case space ($m^3$) |
|---|---|---|---|
| Only loading size A | 0.752 | 0.857 | 0.104 |

It is understood that since the prior art device for loading the LCD substrates requires four package boxes of various sizes after a large substrate is divided into four middle ones with different sizes, there may be situations occurred as follows: The amount of substrates packaged in the boxes of different sizes do not accord with one another. As such, accurate estimation of the substrates becomes difficult, and material management increases difficulties. The use of storage space is reduced. The use of operating platform space is reduced to accordingly increase the operating difficulty on the production line. The molding cost is increased because four sets of molds are required. The material cost is increased because four kinds of package boxes are necessary. For the same loading volume, a low loading and thus a high remaining space are present to accordingly increase the transport cost.

By contrast, according to the present invention, differently sized substrates can be loaded in a tray and then the tray is loaded in a package box. Thus, the differently sized substrates are concurrently loaded in the package box, and that the problems inherent in the prior art are overcome to thereby prevail in terms of assembly and management and of cost and transportation. For assembly and management, it is achieved that the divided substrates can be packed into the same package box as soon as a large substrate is divided (into four differently sized middle substrates), while the existing molds are still usable without affecting the original structure design, the size of the box for packaging maintains unchanged, the wastefulness on storage space is reduced and thus the utility is increased; flow control for the management is simplified to thus easily control the amount of goods delivered; fetching the substrates on the production line becomes easier and quicker; and the operating platform space at the production line is increased. For the cost and transport, it is achieved that the material cost is reduced; the molding cost is reduced and the all-purpose ability increased; the box space is effectively used to thus reduce the waste; the substrate loaded amount is increased without changing the original box structure; the existing iron case maintains unchanged in dimension and is still usable; with the same volume a higher loading than the prior art can be obtained; the used space in an iron case is increased due to the one-size package box to thus reduce the waste; and the transport cost is relatively reduced due to the higher loading.

Although the present invention has been explained in relation to its preferred embodiment, it is to be understood that many other possible modifications and variations can be made without departing from the spirit and scope of the invention as hereinafter claimed.

What is claimed is:

1. A tray for loading substrates with various sizes, comprising:

a base which has an upper surface with one or more grooves;

an outer frame located around four edges of the upper surface of the base to thereby form a first space, the outer frame having two oppositely arranged first cavities;

a plurality of lateral supporters which are arranged on the base at the four edges defining the first space against the outer frame and have second cavities arranged on internal surfaces of the lateral supporters and corresponding to the one or more grooves on the upper surface of the base; and a plurality of corner bumps which are arranged at four corners inside the outer frame, and which are adjacent to the lateral supporters, the base, and the outer frame, wherein a top surface of each of the corner bumps is below an upper edge portion of the outer frame, wherein each corner bump of the plurality of corner bumps has a plurality of buffer openings located at corners of each corner bump.

2. The tray as claimed in claim 1, wherein the one or more grooves are located in the middle of the tray.

3. The tray as claimed in claim 1, wherein the one or more grooves are cross-grooves.

4. The tray as claimed in claim 1, wherein each of the corner bumps has the same height, which is greater than the height of the lateral supporters.

5. The tray as claimed in claim 1, wherein the lateral supporters have the same height at opposite locations and have different heights at adjacent locations.

6. A package box, comprising:

a box base;

a box frame which has corners and which is located around four edges of an upper surface of the box base to thereby form a second space; and one or more trays for loading substrates with various sizes, which are contained in the second space, and each tray of the one or more trays comprises:

a base which has an upper surface with one or more grooves;

an outer frame located around four edges of the upper surface of the base to thereby form a first space, the outer frame having two oppositely arranged first cavities;

a plurality of lateral supporters which are arranged on the base at the four edges defining the first space against the outer frame and have second cavities arranged on internal surfaces of the lateral supporters and corresponding to the one or more grooves on the upper surface of the base; and a plurality of corner bumps which are arranged at corners inside the outer frame, and which are adjacent to the lateral supporters, the base and the outer frame, wherein a top surface of each of the corner bumps is below an upper edge portion of the outer frame, wherein each corner bump of the plurality of corner bumps has a plurality of buffer openings located at corners of each corner bump; and wherein a tray recess is arranged at one or more inner walls of the box frame and a tray opening is arranged at each of the corners of the box frame.

7. The package box as claimed in claim 6, wherein an interval between opposite inner walls of the box frame is equal to a length or width of the one or more trays.

8. The package box as claimed in claim 6, further comprising an upper cover to seal the second space.

9. The package box as claimed in claim 6, wherein the tray recess is arranged respectively on the opposite inner walls of the box frame.

* * * * *